US006871551B2

(12) United States Patent
Beller et al.

(10) Patent No.: US 6,871,551 B2
(45) Date of Patent: Mar. 29, 2005

(54) APPARATUS FOR GENERATING AND CONDUCTING A FLUID FLOW, AND METHOD OF MONITORING SAID APPARATUS

(75) Inventors: Johann Beller, Rosshaupten (DE); Robert Zeller, Kempten (DE)

(73) Assignee: Endress + Hauser Wetzer GmbH + Co. KG, Obere Wank (DE)

( * ) Notice: Subject to any disclaimer, the term of this patent is extended or adjusted under 35 U.S.C. 154(b) by 0 days.

(21) Appl. No.: 09/884,955

(22) Filed: Jun. 21, 2001

(65) Prior Publication Data

US 2002/0001527 A1 Jan. 3, 2002

Related U.S. Application Data

(60) Provisional application No. 60/230,926, filed on Sep. 13, 2000.

(30) Foreign Application Priority Data

Jun. 28, 2000 (EP) ..... 00113614

(51) Int. Cl.[7] ..... G01F 1/00
(52) U.S. Cl. ..... 73/861
(58) Field of Search ..... 73/861; 29/25.35; 417/474

(56) References Cited

U.S. PATENT DOCUMENTS

| | | | |
|---|---|---|---|
| 4,909,710 | A | 3/1990 | Kaplan et al. |
| 5,165,873 | A | 11/1992 | Meijer |
| 5,173,038 | A | 12/1992 | Hopfensperger et al. |
| 5,263,830 | A | 11/1993 | Goi et al. |
| 5,340,290 | A | 8/1994 | Clemens |
| 5,683,233 | A | 11/1997 | Moubayed et al. |
| 5,701,646 | A | 12/1997 | Nabity et al. |
| 5,871,341 | A | 2/1999 | Melody |
| 5,888,052 | A | 3/1999 | Hill |
| 5,935,106 | A | 8/1999 | Olsen |

FOREIGN PATENT DOCUMENTS

| | | |
|---|---|---|
| CA | 2113474 | 3/1993 |
| WO | WO 97/41353 | 11/1997 |
| WO | WO 98/22713 | 5/1998 |
| WO | WO 98/31935 | 7/1998 |

*Primary Examiner*—Harshad Patel
(74) *Attorney, Agent, or Firm*—Bacon & Thomas, PLLC

(57) ABSTRACT

The apparatus comprises a displacement pump with at least one flow vessel, with a pump drive, and with a support means for holding the flow vessel. Furthermore, the apparatus comprises a measuring arrangement responsive to the displacement motions performed by the flow vessel, wherein said displacement motions are picked up by a pressure sensor diposed at the flow vessel or by a strain sensor disposed at the support means. The measuring arrangement serves to sense an actual displacement motion of the flow vessel robustly and reliably, and to deliver a measurement signal representative of this motion. The signal is particularly suited for generating a flow rate estimate representative of the instantaneous volume flow rate and/or for generating a status signal signaling a current operational status. Further, a method is disclosed which supplies information serving to monitor such an apparatus. The apparatus is suitable for using in a sampler.

25 Claims, 6 Drawing Sheets

14
15
1
13
E

1
I
I
13
11
12
13A

APPARATUS FOR GENERATING AND CONDUCTING A FLUID FLOW, AND METHOD OF MONITORING SAID APPARATUS

This application claims the benefit of provisional application 60/230,926 filed on Sep. 13, 2000.

FIELD OF THE INVENTION

This invention relates to an apparatus for generating and conducting a fluid flow comprising a displacement pump and a measuring arrangement, and to a method of monitoring said apparatus.

BACKGROUND OF THE INVENTION

Displacement pumps, as is well known, are pumps which generate a discontinuous fluid flow, particularly a pulsing fluid flow, in the lumen of a flow vessel deformable at least in sections, particularly elastically, such as a flexible tube. For example, U.S. Pat. Nos. 4,909,710, 5,165,873, 5,173,038, 5,263,830, 5,340,290, 5,683,233, 5,701,646, 5,871,341, and 5,888,052 as well as WO-A 97/41353, WO-A 98/22713 and WO-A 98/31935 each disclose an apparatus for generating and conducting a discontinuous fluid flow which comprises a displacement pump with at least one flow vessel of deformable lumen, which serves to conduct the fluid flow, and with a pump drive for deforming the lumen of the flow vessel.

During operation of the displacement pump, the pump drive acts on sections of the fluid-conducting flow vessel such that displacement motions are imparted to the flow vessel which temporarily deform the lumen of the flow vessel, particularly in an oscillating manner, thus transferring the fluid in the desired direction of flow. In each of the displacement pumps disclosed in U.S. Pat. Nos. 4,909,710, 5,173,038, 5,340,290, 5,701,646, and 5,871,341 and in WO-A 97/41353, peristaltic displacement motions are produced by a non-circular-cylindrical surface of a pump drive rotating about an axle, which surface rests against the flow vessel, while in U.S. Pat. Nos. 5,165,873, 5,263,830, 5,683,233, and 5,888,052 as in WO-A 98/31935, the displacement motions are caused by linear motions that a pump drive comprising pumping fingers performs against the flow vessel.

The drive motor for the pump drive is usually an electric motor coupled directly to the pump drive by a drive shaft. The drive motor and the pump drive may also be coupled together by a toothed gearing or a belt drive. Furthermore, an eccentric or cam disk or a crank mechanism, for example, may be used to provide mechanical coupling between the electric motor and the pump drive, see WO-A 98/22713 and U.S. Pat. Nos. 5,165,873, 5,263,830, 5,683,233, and 5,888,052. Instead of an electric motor, a piston-type air motor or a hydraulic motor can be used as the drive motor for producing linear finger motions, as is disclosed in WO-A 98/31935, for example.

Displacement pumps of the kind described, because of a substantially homogeneous, smooth internal wall of the flow vessel and because of the absence of drive elements rotating in the fluid flow, are particularly suited for applications in which stringent chemical and/or biological purity requirements are placed on the fluid-conducting lumen of the flow vessel. Therefore, displacement pumps are frequently used in samplers for chemobiological analyses, particularly in drinking water and sewage treatment plants. Such samplers with a displacement pump are shown in U.S. Pat. Nos. 5,587,926 and 5,701,646, for example.

A physical parameter that is important for the operation of such samplers, particularly for metering liquid samples, is the actual volume of liquid delivered or metered. To determine this volume, the instantaneous volume flow rate of the liquid is determined as a measure of the volume of liquid delivered per unit time, and integrated over a delivery time.

During steady-state operation of the displacement pump, the volume flow rate is strongly dependent on the rate of the displacement motions. This relationship is virtually linear over a wide operating range of the pump, i.e., the volume flow rate is proportional to the rate of the displacement motions, and thus to a set oscillation frequency of the lumen. Therefore, particularly during steady-state operation of the displacement pump, the calculation of the volume of fluid delivered is frequently based on an average volume flow rate for a set displacement motion.

The displacement motions of the flow vessel, and thus the oscillations of the lumen of the vessel, are commonly determined indirectly. To accomplish this, a drive motion of the drive motor is sensed, for example at the motor's drive shaft, using electrodynamic or optical revolution counters, and mapped into a drive signal representative of this drive motion. In suitable evaluation electronics, the drive signal is converted into the volume flow rate and/or into measurement signals representative of the volume of fluid delivered.

However, the drive motions, and thus the measurement signals derived therefrom, are representative of the volume flow rate only if, on the one hand, the flow vessel is filled with liquid in a known manner, particularly completely, and if, on the other hand, no slip occurs between the pump drive and the drive motor. Slip may easily occur in the case of a belt drive or in the case of a pump drive that is merely press-fitted to the drive shaft.

This degree of filling of the flow vessel is strongly dependent on the mounting position of the flow vessel, particularly on the instantaneous suction head. This can be determined a priori, e.g., during start-up, and stored as a setting value in the evaluation electronics, but in the case of samplers, particularly in the case of mobile samplers, the mounting position is variable, i.e., it must be determined anew for each application and, if necessary, stored. Furthermore, the mounting position, particularly also in the case of stationary samplers, may vary because the liquid level at a liquid-sampling location is subject to more or less wide variations.

It has also turned out that, when viewed over the entire operating time, material properties of the flow vessel, such as its tightness, its elasticity, or a property of the inside wall, may also be subject to permanent changes. For instance, deposits on the inside wall may lead to necking or clogging of the flow vessel, and must be detected in time or precluded. Also, damage to the flow vessel, such as leaks, may result in the apparatus becoming useless.

To monitor a displacement pump, particularly a current operational status of the pump drive and/or the flow vessel, additional measures are therefore necessary which detect one or more of the aforementioned parameters during operation and which compensate for the effect of these parameters on the calculated volume flow rate.

SUMMARY OF THE INVENTION

It is therefore an object of the invention to provide an apparatus comprising a displacement pump and a measuring arrangement which robustly and reliably senses an actual displacement motion of the flow vessel and which delivers a measurement signal representative of this motion that is particularly suited for generating a flow rate estimate representative of the instantaneous volume flow rate and/or for generating a status signal signaling a current operational status.

Another object of the invention is to provide a method which supplies information serving to monitor such an apparatus.

To attain the first-mentioned object, a first variant of the invention provides an apparatus for generating a fluid flow, said apparatus comprising:

a displacement pump
- with at least one flow vessel of deformable lumen, which serves to conduct a fluid,
- with a pump drive for producing displacement motions of the flow vessel which deform the lumen and cause the fluid flow, and
- with a support means for holding the flow vessel; and a measuring arrangement responsive to the displacement motions performed by the flow vessel,
- with a pressure sensor for sensing a static pressure in the fluid and providing a sensor signal representative of the displacement motions, and
- with evaluation electronics for the sensor signal.

A second variant of the invention provides an apparatus for generating a fluid flow, said apparatus comprising:

a displacement pump
- with at least one flow vessel of deformable lumen, which serves to conduct a fluid,
- with a pump drive for producing displacement motions of the flow vessel which deform the lumen and cause the fluid flow, and
- with a support means for holding the flow vessel,
  - the flow vessel being compressed by the pump drive in operation temporarily and in sections and forced against the support means such that the support means is elastically strained; and a measuring arrangement responsive to the displacement motions performed by the flow vessel,
- with a strain sensor for sensing a strain of the support means and providing a sensor signal representative of the displacement motions performed by the flow vessel, and
- with evaluation electronics for the sensor signal.

Furthermore, the invention provides a method of monitoring an apparatus serving to generate a fluid flow and comprising:

a displacement pump
- with at least one flow vessel of deformable lumen, which serves to conduct a fluid,
- with a pump drive for producing displacement motions of the flow vessel which deform the lumen and cause the fluid flow,
- with a drive motor for the pump drive, and
- with a support means for holding the flow vessel; and a measuring arrangement responsive to the displacement motions of the flow vessel and comprising a pressure sensor for sensing a static pressure in the fluid, said method comprising the steps of:

causing drive motions of the drive motor for producing the displacement motions of the flow vessel;

sensing the first pressure with the pressure sensor for generating a sensor signal representative of the displacement motions; and deriving from the sensor signal a status signal signaling a current operational status of the apparatus.

Furthermore, the invention consists in the use of an apparatus according to the invention in a sampler, especially in a mobile sampler or a portable sampler.

In a first preferred embodiment of the first or second variant of the invention, the evaluation electronics derive from the sensor signal a flow rate estimate representative of an instantaneous volume flow rate of the fluid.

In a second preferred embodiment of the first or second variant of the invention, the evaluation electronics derive from the sensor signal a first measurement signal representative of a frequency of the displacement motions.

In a third preferred embodiment of the first or second variant of the invention, the evaluation electronics derive from the sensor signal a volume estimate representative of a totalized volume of fluid delivered.

In a fourth preferred embodiment of the first or second variant of the invention, the evaluation electronics derive from the sensor signal a status signal representative of a current operational status of the displacement pump.

In a fifth preferred embodiment of the first or second variant of the invention the pump drive is a rotary pump drive.

In a sixth preferred embodiment of the first or second variant of the invention the pump drive is a linear pump drive.

In a seventh preferred embodiment of the first variant of the invention, the evaluation electronics derive from the sensor signal a second measurement signal representative of a suction head of the apparatus.

A basic idea of the invention is to determine the displacement motion of the flow vessel, or the oscillations of its lumen, not on the basis of their causes, namely the drive motions of the drive motor, but on the basis of their effects in the apparatus. The reactions of the apparatus to the displacement motions, which reactions have to be sensed, are, for example, a varying pressure in the fluid flow and/or a partial deformation, particularly an elastic deformation, of the support means of the displacement pump.

One advantage of the invention is that the volume flow rate can be determined independently of the mechanical coupling provided between the drive motor and the pump drive and on the basis of a single sensor signal.

Another advantage of the invention is that the measuring arrangement, and thus the method, can be used both in apparatus with electric-motor-driven displacement pumps and in apparatus with hydraulically or pneumatically operated displacement pumps.

A further advantage of the invention is that existing apparatus or samplers of the kind described can be readily retrofitted with such a measuring arrangement.

BRIEF DESCRIPTION OF THE DRAWINGS

The invention and further advantages will become more apparatus from the following description of embodiments taken in conjunction with the accompanying drawings, in which like reference characters represent like parts throughout the various figures. Reference characters that have already been assigned are not shown in subsequent figures if this contributes to clarity. In the drawings.

DETAILED DESCRIPTION OF EXEMPLARY EMBODIMENTS

Figure 1:
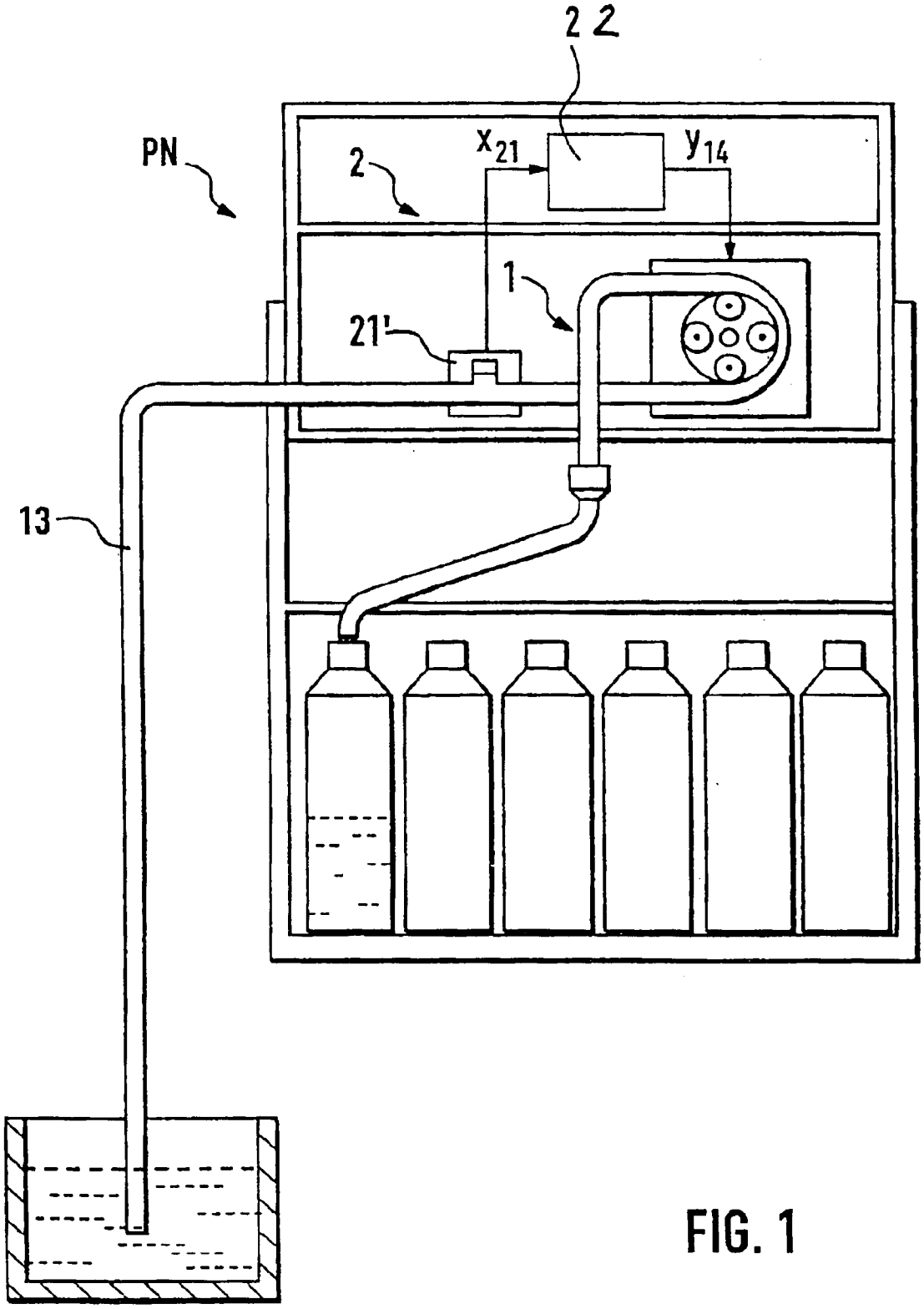
FIG. 1 shows schematically the use of an apparatus for transferring a fluid in a sampler.

While the invention is susceptible to various modifications and alternative forms, exemplary embodiments thereof have been shown by way of example in the drawings and will herein be described in detail. It should be understood, however, that there is no intent to limit the invention to the the particular forms diclosed, but on the contrary, the intention is to cover all modifications, equivalents, and alternatives falling within the spirit and scope of the invention as defined by the intended claims.

FIG. 1 shows an apparatus for transferring a fluid, particularly liquid, using a displacement pump 1. The apparatus is especially suited for use in samplers PN for taking samples of liquids, e.g., drinking water or sewage water, and, if necessary, for storing such samples.

Figure 3:
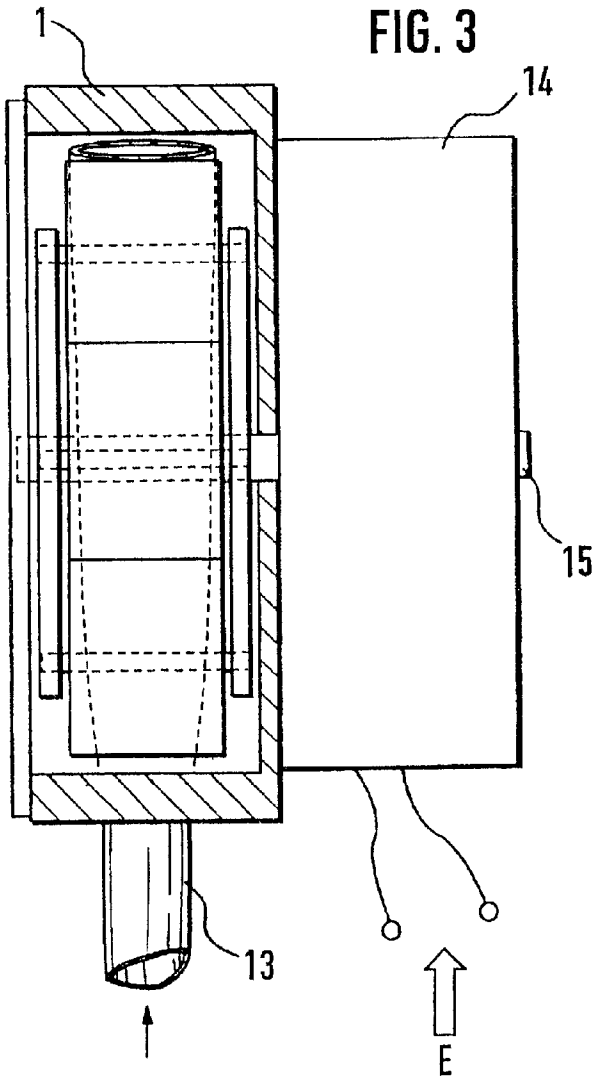
FIG. 3 is a part section taken along line I—I of FIG. 2.
Figure 2:
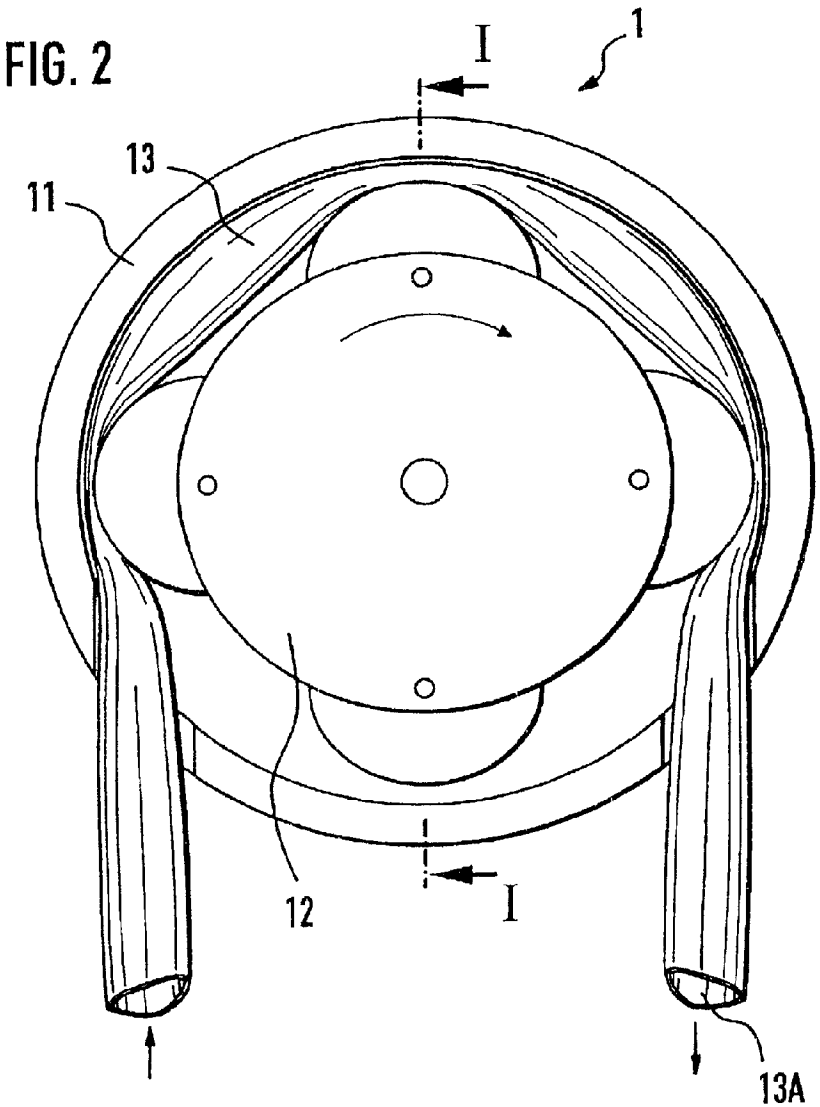
FIG. 2 is a front view of an embodiment of a displacement pump of the apparatus of FIG. 1.

In one embodiment of the invention, shown in FIGS. 2 and 3, displacement pump 1 comprises a support means 11 designed as a pump casing, a pump drive 12 held by support means 11, particularly a drive designed as a displacing member, and a flow vessel 13 of variable lumen 13A, particularly of a cross section variable at least in sections, for conducting the fluid. For flow vessel 13, all elastic tubes commonly used in such displacement pumps, e.g., tubes made of polyethylene or silicone, can be employed. Flow vessel 13 may be of one-part or multipart construction.

During operation of the apparatus, a displacement motion $s_{13}$, particularly a peristaltic motion, of predeterminable frequency, e.g., a frequency in a range of 10 Hz to 20 Hz, is imparted by pump drive 12 to flow vessel 13 such that the fluid in the oscillating lumen 13A of flow vessel 13 flows in a predetermined direction, particularly in a pulsing manner. In the apparatus of the embodiment, the displacement motion is a wave motion of the wall of flow vessel 13, and thus of the lumen 13A enclosed by this wall, with the wave velocity determining the volume flow rate, see FIG. 4.

Figure 4:
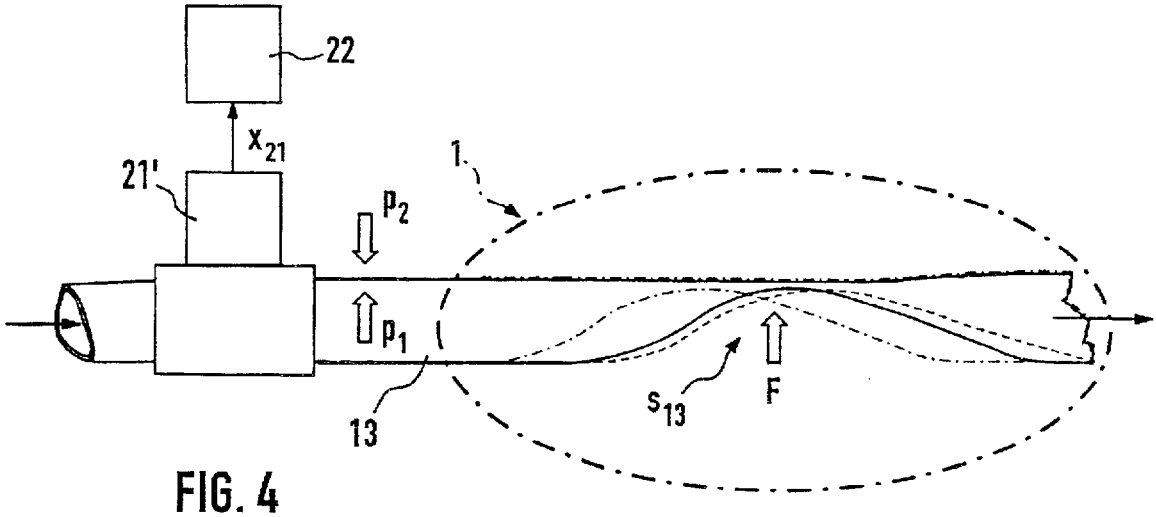
FIG. 4 shows schematically a first effect of the displacement pump of FIG. 2 as well as a measuring arrangement responsive to this first effect.

To produce the displacement motion $s_{13}$, pump drive 12, as shown schematically in FIG. 4, acts on flow vessel 13 with a time-variable and locally variable compression force F, particularly a periodically variable force, such that within an effective compression range, flow vessel 13, and thus its lumen 13A, is deformed, particularly elastically, thus displacing the fluid. In the displacement pump 1 of the embodiment shown in FIGS. 2 and 3, this is accomplished by causing the pump drive 12 of noncircular cross section to roll on flow vessel 13, thereby periodically compressing the flow vessel 13 against support means 11 and allowing it to relax. To that end, as shown in FIG. 2, sections of pump drive 12 rest against flow vessel 13, which is also held by support means 11.

In the embodiment, pump drive 12 is designed as a drum- or disk-shaped displacing member of noncircular cross section, i.e., a displacing member with a non-circular-cylindrical surface. To that end, the displacing member has four spaced-apart roller elements, particularly rotatably mounted elements, which during operation of displacement pump 1 act sequentially on flow vessel 13 according to a set direction of rotation of pump drive 12. Pump drive 12 can also be implemented with all other displacing members of noncircular cross section that are commonly used in such pumps, or with a rotary pump drive provided with eccentrically mounted roller elements, see U.S. Pat. Nos. 5,173,038, 5,683,233, 5,701,646, and 5,871,341 as well as WO-A 97/41353, the disclosers of which are hereby incorporated by reference. In place of rotary pump drives, linear pump drives implemented with, e.g., pumping fingers or helical displacing members can be used, see U.S. Pat. Nos. 4,909,710, 5,165,873, 5,888,052, and 5,263,830, the disclosers of which are hereby incorporated by reference.

Pump drive 12, as is usual with displacement pumps with a rotary pump drive, is mechanically coupled, e.g., by a gearing or a driving belt, to a drive shaft 15 of a drive motor 14, particulary an electric motor; it may also be slipped directly over drive shaft 15. In operation, drive motor 14 performs drive motions at a predetermined rate, here rotary motions at a preferably adjustable motor speed proportional to the frequency of the displacement motions $s_{13}$, e.g., at a speed of 200 $min^{-1}$ to 3000 $min^{-1}$, which, after being geared down if necessary, are transmitted via drive shaft 15 to pump drive 12. If pump drive 12 is a linear drive, it may also be driven by a hydraulic motor or an air motor, see WO-A 98/31935, the disclosers of which are hereby incorporated by reference.

To draw liquid during operation of the apparatus, flow vessel 13 communicates at an inlet end with a liquid-sampling location. As shown schematically in FIG. 1, liquid can be sampled by immersing flow vessel 13 in the liquid, which is conducted in an open channel or contained in a basin, and drawing the liquid in against the force of gravity as the lumen 13A oscillates in the manner described above; the liquid may also be allowed to flow in from a suitable liquid-sampling location in the direction of gravity and/or from a pipe.

The apparatus further comprises a measuring arrangement 2 which responds to the displacement motions $s_{13}$ performed by flow vessel 13. Measuring arrangement 2 comprises evaluation electronics 22, which are supplied with a sensor signal $x_{21}$ representative of the displacement motions $s_{13}$.

To generate sensor signals $x_{21}$, measuring arrangement 2, according to a first variant of the invention, comprises a preferably capacitive or resistive pressure sensor 21', which is in contact with the fluid and which, as shown schematically in FIG. 4, responds to an instantaneous first pressure $p_1$, particularly a static pressure, that exists in the fluid in lumen 13A. For this purpose, pressure sensor 21' has at least one pressure-measuring chamber that is isolated from lumen 13A by at least one pressure diaphragm and on which the pressure $p_1$ acts in operation via this at least one pressure diaphragm.

The pressure to be sensed, $p_1$, is an instantaneous internal pressure that is adjusted by means of displacement pump 1 in an inlet-side region of flow vessel 13, and that exhibits a calibratable dependence on a current operational status of the apparatus, e.g., on the mounting position and/or the filling of the flow vessel and/or the instantaneous frequency of the displacement motions $s_{13}$. During operation of displacement pump 1, pressure $p_1$ is set at least temporarily, particularly also with flow vessel 13 not filled with liquid, at a value in the range of 200 hPa to 400 hPa (=0.2 bar to 0.4 bar), and thus at a value lower than a static second pressure $p_2$, which acts on flow vessel 13 from outside. Pressure $p_2$ may, for instance, be an atmospheric pressure of about 1000 hPa.

In this variant of the invention, measuring arrangement 2 serves in particular to sense pressure $p_1$ and map it into sensor signal $x_{21}$ even if pressure $p_1$ is set at a value lower than that of pressure $p_2$. To accomplish this, pressure sensor 21' may be designed either as an absolute pressure sensor with an evacuated pressure-measuring chamber or as a relative pressure sensor that senses pressure $p_1$ relative to pressure $p_2$. To mount pressure sensor 21', a portion of flow vessel 13 is preferably designed as an adapter, as shown schematically in FIG. 4.

Figure 5:
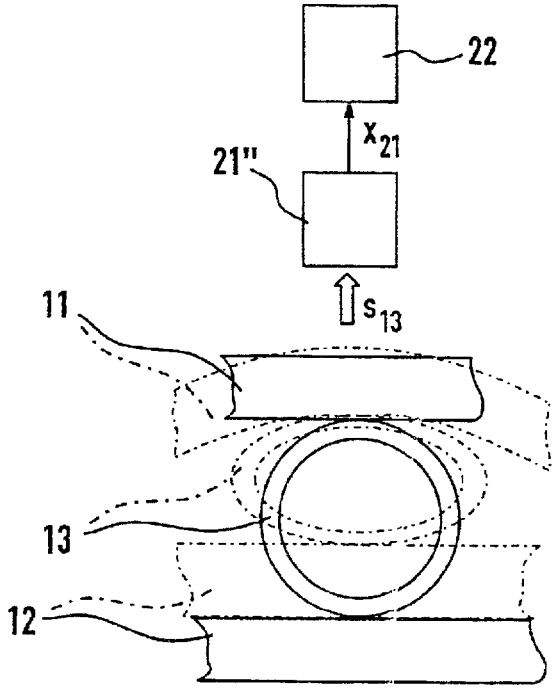
FIG. 5, a section of the side of view of FIG. 3, shows schematically a second effect of the displacement pump as well as a measuring arrangement responsive to this second effect.

According to a second variant of the invention, measuring arrangement 2 comprises a piezoresistive strain sensor 21", particularly a strain sensor mounted directly on support means 11, which, as shown schematically in FIG. 5, senses strain in support means 11 caused by displacement motions $s_{13}$ of flow vessel 13, and which converts this strain into sensor signal $x_{21}$. Strain sensor 21" may also be a displacement, velocity, or acceleration sensor for sensing relative or absolute strain.

Because of the compression of flow vessel 13 against support means 11, the compressive force F of pump drive 12 acting on flow vessel 13 is partially converted to a compression spring force acting on support means 11, whereby support means 11 is also deformed in sections, particularly elastically. This is represented in FIG. 5 by the dotted lines. Through this deformation, support means 11 is subjected to a measurable strain whose extent is determined in particular by the instantaneous pressure $p_1$ in lumen 13A of flow vessel 13. The compression spring force, and thus the strain in support means 11, is also dependent on the material, particularly on its modulus of elasticity, and/or on an instantaneous three-dimensional shape of flow vessel 13, for example.

This dependence of the deformation of support means 11 can be accurately determined by suitable calibration measurements, in which flow vessel 13 is successively filled with liquids and left empty in a defined manner, with a corresponding instantaneous value of sensor signal $x_{21}$ being stored as a reference value for the instantaneous filling in evaluation electronics 22.

The sensor signal $x_{21}$ generated by pressure sensor 21' according to the first variant of the invention can advantageously be used to determine a flow rate estimate $x_v$, which is representative of the instantanous volume flow rate, and/or a volume estimate, which is representative of the volume flow rate integrated over a delivery time.

Figure 6:
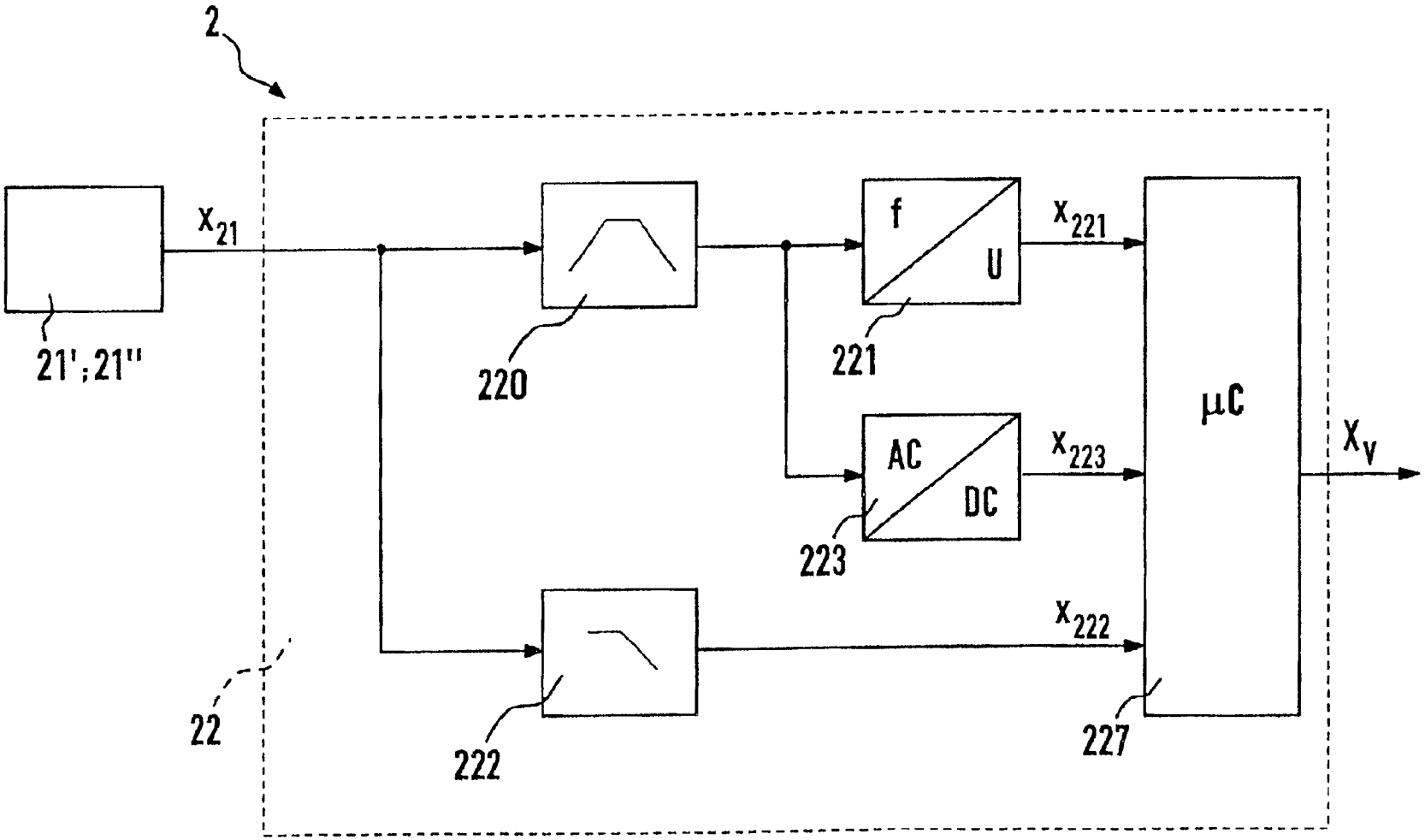
FIG. 6 is a schematic block diagram of an embodiment of the evaluation electronics of the measuring arrangement of FIG. 4 and/or FIG. 5.

In a preferred embodiment of the first variant of the invention, evaluation electronics 22, as shown in FIG. 6, comprise a bandpass circuit 220 of adjustable bandwidth, which transmits a component of sensor signal $x_{21}$, particularly a component with the frequency of displacement motion $s_{13}$, and a frequency counter 221 connected to the output of bandpass circuit 220. Bandpass circuit 220 may, for instance, be implemented with a switched-capacitor filter and/or a voltage-controlled active filter as is familiar to those skilled in the art.

Bandpass circuit 220 and frequency counter 221 convert sensor signal $x_{21}$ to a first measurement signal $x_{221}$, particularly a digital signal, with an instantaneous value $x_\omega$ of measurement signal $x_{221}$ representing the frequency of displacement motions $s_{13}$.

Bandpass circuit 220 serves in particular to remove DC components of sensor signal $x_{21}$ and reject higher-frequency interference voltages. Accordingly, the bandwidth of bandpass circuit 220 is so adjusted that any changes in the frequency of displacement motion $s_{13}$, for example changes due load-induced variations in motor speed, will not result in sensor signal $x_{21}$ being blocked. If this frequency varies in a wide range of, e.g., $\pm 5\ s^{-1}$, the bandwidth of bandpass circuit 220, which is preferably configured as a switched-capacitor filter, can also be tracked, for example by means of an instantaneous motor speed setting generated by evaluation electronics 22. The setting may be derived from a drive signal picked off directly from the drive motor in the above-mentioned manner.

For an apparatus of the kind described, the volume flow rate of a liquid is dependent on the concrete realization of displacement pump 1, namely on the design of pump drive 12 and flow vessel 13, and on the frequency of displacement motions $s_{13}$.

Besides being determined by the respective nature of displacement motion $s_{13}$, the instantaneous volume flow rate is dependent on the suction head, which is determined by the instantaneous spatial distance between the displacement pump and a liquid level. In the case of a permanently installed apparatus, e.g., if the apparatus is used in a stationary sampler PN, and with a practically invariable liquid level, this suction head must be determined at the start-up of the apparatus and stored as a fixed value $K_h$ in evaluation electronics 22. Then, particularly with a liquid flowing in the steady state, the following simple proportionality, which is readily verifiable by suitable calibration measurements, holds for the flow rate estimate $X_v$:

$$X_v = K_1 \cdot K_h \cdot X_\omega \tag{1}$$

where $K_1$ is a constant representing the dependence of the volume flow rate on the frequency of the displacement motion $s_{13}$ and on the instantaneous suction head, particularly a constant to be determined by calibration. If necessary, the flow rate estimate $X_v$ may also be approximated by a higher-order polynomial, of course.

Thus, during steady-state operation of the apparatus, the flow rate estimate $X_v$ can advantageously be derived directly from measurement signal $x_{221}$. In the case of the displacement pump 1 of the embodiment shown in FIG. 2, the volume flow rate is proportional to four times the frequency of displacement motion $s_{13}$. To determine the volume estimate, the flow rate estimate $X_v$ must only be integrated over the delivery time, for example by multiplying this estimate $X_v$ by the latter or by a number of measured zero crossings of the bandpass-filtered sensor signal provided at the output at bandpass circuit 220.

If the mounting position of the flow vessel 13 is variable, e.g., if the apparatus is used in a mobile or portable sampler PN, and/or with a varying liquid level, the instantaneous suction head must be updated for a more accurate determination of the flow rate estimate $X_v$.

Therefore, in a further preferred embodiment of the first variant of the invention, a second measurement signal $x_{222}$ is derived from sensor signal $x_{21}$, with an instantaneous value $X_h$ of measurement signal $x_{222}$ representing the instantaneous suction head. In Eq. (1), therefore, only the fixed value $K_h$ has to be replaced by the value $X_h$ of measurement signal $x_{222}$, so that the flow rate estimate $X_v$ will now be given by $$X_v = K_1 \cdot X_h \cdot X_\omega \tag{2}$$

To generate measurement signal $x_{222}$, sensor signal $x_{21}$ is smoothed by a low-pass circuit 222 of evaluation electronics 22, as shown in FIG. 6. Low-pass circuit 222 has a cutoff frequency much lower than the frequency of displacement motion $s_{13}$, namely a cutoff frequency of, e.g., 0.5 Hz to 2 Hz. Thus, of the sensor signal $x_{21}$, only a component of zero frequency serving as measurement signal $x_{222}$, e.g., an instantaneous mean value of sensor signal $x_{21}$, is passed by low-pass circuit 222. A transmitted instantaneous mean value of sensor signal $x_{21}$ serves as a measured value $X_h$ representing the instantaneous suction head. With increasing suction head, e.g., with decreasing liquid level, the pressure $p_1$ sensed by sensor 21 would drop and the sensor signal $x_{21}$ would have a correspondingly decreasing mean value; analogously, with decreasing suction head, the mean value of sensor signal $x_{21}$ would increase.

Furthermore, evaluation electronics 22 can serve to derive from sensor signal $X_{21}$ a third measurement signal $x_{223}$, which is representative of a degree to which flow vessel 13 is filled with liquid. To accomplish this, sensor signal $x_{21}$, as shown in FIG. 6, is applied through bandpass circuit 220 to a rectifier circuit 223 which provides at its output the measurement signal $x_{223}$ in the form of a DC voltage, with an instantaneous value of measurement signal $x_{223}$ serving as an estimate of the instantaneous degree of filling; if necessary, a corresponding direct current may, of course, be used for the measurement signal $x_{223}$. Rectifier circuit 223 can be implemented with a conventional amplitude-measuring or rms-measuring AC-DC converter, for example.

To implement Eqs. (1) and/or (2), evaluation electronics 22 further comprise a microcomputer 227, to which the measurement signal $x_{221}$ and/or the measurement signal $x_{223}$ and, if necessary, the measurement signal $x_{222}$ are applied through signal ports that convert the signals from analog to digital form; if necessary, frequency counter 221 and/or rectifier circuit 223 may, of course, be implemented as digital circuits, which then receive a sensor signal that was digitized at the output of bandpass circuit 220.

Sensor signal $X_{21}$, generated by pressure sensor 21' according to the first and/or second variants of the invention, can also be used in evaluation electronics 22 to derive a status signal Z, particularly a digital status signal, which signals a current operational status of displacement pump 1 and, hence, a current operational status of the sampler PN comprising the apparatus.

Figure 7:
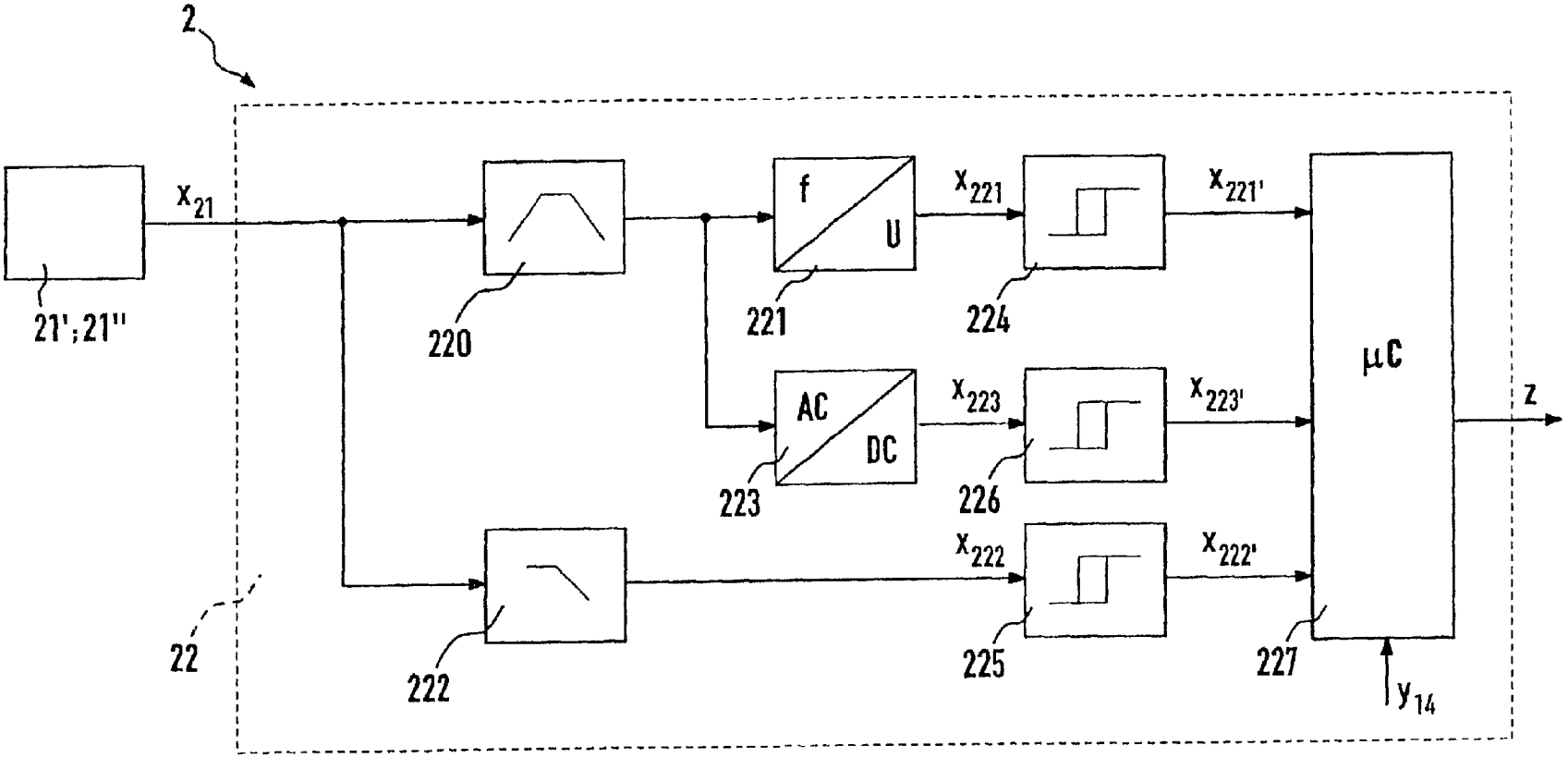
FIG. 7 is a schematic block diagram of an embodiment of the evaluation electronics of the measuring arrangement of FIG. 1.

Therefore, in a preferred embodiment of the first or second variant of the invention, evaluation electronics 22, as shown schematically in FIG. 7, comprise a first Schmitt trigger 224, which converts the measurement signal $x_{221}$ delivered by frequency counter 221 to a binary first monitoring signal $x_{221}'$. To that end, measurement signal $x_{221}$ is compared with a frequency reference value of Schmitt trigger 224 which is set so that the monitoring signal $x_{221}'$ is at a high level when the frequency of displacement motion $s_{13}$ is greater than or equal to a minimum frequency during steady-state operation of displacement pump 1. The frequency reference value must be determined and set during start-up, for which purpose the displacement pump 1 is, for example, subjected to a maximum load to be expected during operation.

In another preferred embodiment of the first variant of the invention, the mean value of sensor signal $x_{21}$ being transmitted by low-pass circuit 222 is applied to a second Schmitt trigger 225 of evaluation electronics 22, as shown in FIG. 7. At the output of Schmitt trigger 225, a binary second monitoring signal $x_{222}'$ is available. Monitoring signal $x_{222}'$ serves to signal whether or not the pressure $p_1$ is less than a pressure reference value set at Schmitt trigger 225. Accordingly, the pressure reference value is set so that monitoring signal $x_{222}'$ will be at a high level when pressure $p_1$ is less than or equal to the maximum pressure value that occurs during operation of displacement pump 1 within an undamaged flow vessel 13 communicating with the liquid-sampling location in the manner described above; otherwise, monitoring signal $x_{222}'$ will be at a low level.

In a further preferred embodiment of the first or second variant of the invention, evaluation electronics 22, as shown in FIG. 7, comprise a third Schmitt trigger 226, which receives the measurement signal $x_{223}$. A filling reference value of Schmitt trigger 226 is set so that a binary third monitoring signal $x_{223}'$ provided at its output will be at a high level when flow vessel 13 is filled with at least a predetermined minimum volume of the liquid to be delivered; otherwise, particularly in case of increased air bubbling in the fluid, the monitoring signal will be at a low level. The filling reference value to be set may, for instance, be determined by a suitable calibration measurement and be set during start-up.

Monitoring signal $x_{221}'$, monitoring signal $X_{222}'$, and/or monitoring signal $X_{223}'$ are applied, if necessary through analog-to-digital converters, to microcomputer 227 of evaluation electronics 22. The status signal Z at the output of microcomputer 227 can be delivered serially or in parallel, for example to a display unit of the apparatus serving to visualize the current operational status. The status signal Z may also be applied to control electronics for the displacement pump which, when a fault in the apparatus is detected by measuring arrangement 2, for example, turn the displacement pump 1 off. If necessary, monitoring signal $x_{221}'$, monitoring signal $x_{222}'$, and/or monitoring signal $x_{223}'$ can also be derived from measurement signal $x_{221}$, measurement signal $x_{222}$, and measurement signal $x_{223}$, respectively, using trigger functions implemented in microcomputer 227.

Preferably, microcomputer 227 is also used to implement a triggered start function which serves to evaluate monitoring signal $x_{221}'$, monitoring signal $x_{222}'$, and/or monitoring signal $x_{223}'$ only after turn-on of displacement pump 1, namely after the lapse of a set interval of time corresponding to a starting time.

The start function is triggered using a fourth monitoring signal $y_{14}$ of the apparatus, which signals a drive energy E (see FIG. 3), particularly electric energy, that is fed into displacement pump 1 during operation. Monitoring signal $y_{14}$ may, for instance, be a binary switching signal whose high level signals that displacement pump 1 is on, and whose low level signals that displacement pump 1 is off. Monitoring signal $y_{14}$ may also be a measurement signal that represents, for example, a current being fed into displacement pump 1. Furthermore, monitoring signal $y_{14}$ may also be derived from the aforementioned drive signal using amplitude-measuring or rms-measuring AC-DC converters, for example.

Figure 8:
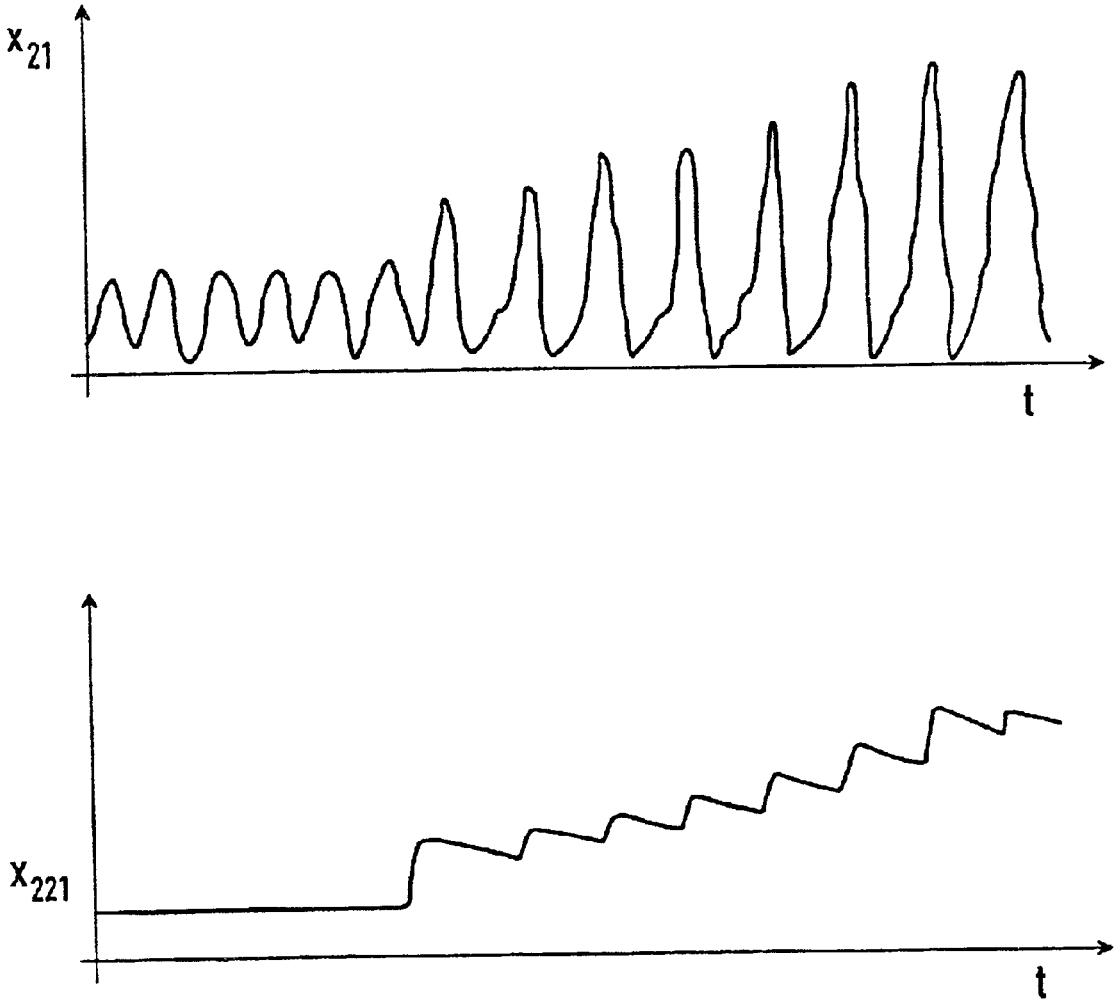
FIG. 8 shows waveforms of signals generated with the measuring arrangement.

The interval of time for the start function is set so that after turn-on, displacement pump 1 is definitely in the steady state if there is no disturbance. The starting time until attainment of steady-state operation must be determined by calibration measurements and converted to the interval of time to be set. FIG. 8 shows by way of example a waveform of sensor signal $x_{21}$ and a corresponding waveform of measurement signal $x_{221}$ during a transition to steady-state operation.

In another preferred embodiment of the first variant of the invention, microcomputer 227 incorporates a first logic function which is activated by the start function and which sets a first signal value for the status signal Z when monitoring signal $x_{222}'$ is at a high level and monitoring signal $x_{223}'$ is simultaneously at a low level.

In that case, the status signal Z may, for instance, signal a clogged flow vessel 13.

In another preferred embodiment of the first variant and/or the second variant of the invention, microcomputer 227 incorporates a second logic function, which is activated by the start function and which sets a second signal value for the status signal Z when monitoring signal $x_{221}'$ is at a high level and monitoring signal $x_{222}'$ is simultaneously at a low level. In that case, the status signal Z may, for instance, signal "flow vessel 13 not immersed in the liquid" and/or "leaky flow vessel 13, completely or partly filled with air". This second signal value for status signal S can also be generated, for example, by comparing measurement signal $x_{221}$ or measurement signal $x_{222}$ with two different signal reference values using two different triggering levels, with the lower one of the two triggering levels being exceeded by the measurement signal $x_{221}$, $x_{222}$ and the higher one being not reached.

In a preferred embodiment of the second variant of the invention, in which sensor signal $x_{21}$ signals the deformation of support means 11 in the manner described above, microcomputer 227 incorporates a third logic function, which is activated by the start function and which sets a third signal value for the status signal Z when monitoring signal $x_{221}'$ is at a low level and monitoring signal $y_{14}$ is simultaneously at a high level. In that case, the status signal Z may, for instance, signal a faulty pump drive 12.

It has turned out that even with pump drive 12 at rest, support means 11, because of an initial tension exerted by flow vessel 13 on its support, exhibits a small elastic deformation which differs measurably from a basic shape of support means 11 when pump drive 12 and/or flow vessel 13 are not installed, for example during maintenance work. By fixing a corresponding lower limit value for sensor signal $x_{21}$, it can be determined in evaluation electronics 22 by a simple comparison with an instantaneous value of sensor signal $x_{21}$ whether pump drive 12 has been installed incorrectly.

In addition to pressure sensor $_{21}'$ and/or strain sensor 21", the measuring arrangement may comprise further sensors, such as temperature sensors used for temperature compensation, which may be mounted on flow vessel 13 or on support means 11, for example.

While the invention has been illustrated and described in detail in the drawings and forgoing description, such illustration and description is to be considered as exemplary not restrictive in character, it being understood that only exemplary embodiments have been shown and described and that all changes and modifications that come within the spirit and scope of the invention as described herein are desired to protected.

What is claimed is:

1. An apparatus for generating a fluid flow, said apparatus comprising:

a displacement pump with at least one flow vessel of deformable lumen, which serves to conduct a fluid, with a pump drive for producing displacement motions of the flow vessel which deform the lumen and cause the fluid flow, and with a support means for holding the flow vessel; and a measuring arrangement responsive to the displacement motions performed by the flow vessel, with a pressure sensor sensing a static pressure in the fluid and providing a sensor signal representative of the displacement motions, and with evaluation electronics for the sensor signal.

2. The apparatus as claimed in claim 1, wherein the evaluation electronics are operable to derive from the sensor signal a flow rate estimate representative of an instantaneous volume flow rate of the fluid.

3. The apparatus as claimed in claim 1, wherein the evaluation electronics are operable to derive from the sensor signal a first measurement signal representative of a frequency of the displacement motions.

4. The apparatus as claimed in claim 1, wherein the evaluation electronics are operable to derive from the sensor signal a volume estimate representative of a totalized volume of fluid delivered.

5. The apparatus as claimed in claim 1, wherein the evaluation electronics are operable to derive from the sensor signal a status signal representative of a current operational status of the displacement pump.

6. The apparatus as claimed in claim 1, wherein the evaluation electronics are operable to derive from the sensor signal a second measurement signal representative of a suction head of the apparatus.

7. The apparatus as claimed in claim 1, wherein the pump drive is a rotary pump drive.

8. The apparatus as claimed in claim 1, wherein the pump drive is a linear pump drive.

9. The apparatus as claimed in claim 1, wherein the pressure sensor contacts fluid within said flow vessel.

10. The apparatus as claimed in claim 1, wherein the pressure sensor senses said static pressure in the fluid relative to a pressure acting on said flow vessel from outside.

11. A sampler for taking samples of a fluid, said sampler comprising an apparatus for generating a fluid flow, said apparatus comprising:

a displacement pump with at least one flow vessel of deformable lumen, which serves to conduct a fluid, with a pump drive for producing displacement motions of the flow vessel which deform the lumen and cause the fluid flow, and with a support means for holding the flow vessel; and a measuring arrangement responsive to the displacement motions performed by the flow vessel, with a pressure sensor sensing a static pressure in the fluid and providing a sensor signal representative of the displacement motions, and with evaluation electronics for the sensor signal.

12. The sampler as claimed in claim 11, wherein the evaluation electronics are operable to derive from the sensor signal a flow rate estimate representative of an instantaneous volume flow rate of the fluid.

13. The sampler as claimed in claim 11, wherein the evaluation electronics are operable to derive from the sensor signal a first measurement signal representative of a frequency of the displacement motions.

14. The sampler as claimed in claim 11, wherein the evaluation electronics are operable to derive from the sensor signal a volume estimate representative of a totalized volume of fluid delivered.

15. The sampler as claimed in claim 11, wherein the evaluation electronics are operable to derive from the sensor signal a status signal representative of a current operational status of the displacement pump.

16. The sampler as claimed in claim 11, wherein the evaluation electronics are operable to derive from the sensor signal a second measurement signal representative of a suction head of the apparatus.

17. The sampler as claimed in claim 11, wherein the pump drive is a rotary pump drive.

18. The sampler as claimed in claim 11, wherein the pump drive is a linear pump drive.

19. The sampler as claimed in claim 11, wherein said sampler is a mobile sampler.

20. The sampler as claimed in claim 11, wherein said sampler is a portable sampler.

21. A method of monitoring an apparatus serving to generate a fluid flow, the apparatus comprising: a displacement pump, with at least one flow vessel of deformable lumen, which serves to conduct a fluid, with a pump drive for producing displacement motions of the flow vessel which deform the lumen and cause the fluid flow, with drive motor for the pump drive, and with a support means for holding the flow vessel; and a measuring arrangement responsive to the displacement motions of the flow vessel and comprising a pressure sensor for sensing a static pressure in the fluid, said method comprising the steps of:

causing displacement motions of the flow vessel for taking a fluid;

sensing the pressure and generating a sensor signal representative of said displacement motions; and deriving from the sensor signal a status signal signaling a current operational status of the apparatus.

22. A method of monitoring a sampler with an apparatus serving to generate a fluid flow, the apparatus comprising: a displacement pump, with at least one flow vessel of deformable lumen, which serves to conduct a fluid, with a pump drive for producing displacement motions of the flow vessel which deform the lumen and cause the fluid flow, with a drive motor for the pump drive, and with a support means for holding the flow vessel; and a measuring arrangement responsive to the displacement motions of the flow vessel and comprising a pressure sensor sensing a static pressure in the fluid, said method comprising the steps of:

causing displacement motions of the flow vessel for taking the fluid;

sensing the pressure and generating a sensor signal representative of said displacement motions; and deriving from the sensor signal a status signal signaling a current operational status of said sampler to be monitored.

23. An apparatus for generating a fluid flow, said apparatus comprising:

a displacement pump with at least one flow vessel of deformable lumen, which serves to conduct a fluid, with a pump drive for producing displacement motions of the flow vessel which deform the lumen and cause the fluid flow, and with a support means for holding the flow vessel; and a measuring arrangement responsive to the displacement motions performed by the flow vessel, with a pressure sensor sensing an instantaneous pressure in the fluid and providing a sensor signal representative of the displacement motions, and with evaluation electronics for the sensor signal.

24. The apparatus as claimed in claim 23, wherein the pressure sensor contacts fluid within said flow vessel.

25. The apparatus as claimed claim 23, wherein the pressure sensor senses static pressure in the fluid relative to a pressure acting on said flow vessel from outside.

* * * * *